US010995755B2

(12) United States Patent
Yamashita et al.

(10) Patent No.: US 10,995,755 B2
(45) Date of Patent: May 4, 2021

(54) CO-ROTATING SCROLL COMPRESSOR

(71) Applicant: MITSUBISHI HEAVY INDUSTRIES, LTD., Tokyo (JP)

(72) Inventors: Takuma Yamashita, Tokyo (JP); Takahide Ito, Tokyo (JP); Keita Kitaguchi, Tokyo (JP); Makoto Takeuchi, Tokyo (JP); Hirohumi Hirata, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 184 days.

(21) Appl. No.: 16/282,978

(22) Filed: Feb. 22, 2019

(65) Prior Publication Data

US 2019/0277291 A1 Sep. 12, 2019

(30) Foreign Application Priority Data

Mar. 12, 2018 (JP) ..... JP2018-044164

(51) Int. Cl.
*F01C 1/02* (2006.01)
*F04C 29/02* (2006.01)
(Continued)

(52) U.S. Cl.
CPC ..... *F04C 29/021* (2013.01); *F04C 18/0215* (2013.01); *F04C 18/0238* (2013.01);
(Continued)

(58) Field of Classification Search
CPC ..... F04C 29/021; F04C 29/0071; F04C 18/0215; F04C 18/0238; F04C 18/00; F04C 2240/603; F01C 1/0238; F01C 1/023
See application file for complete search history.

(56) References Cited

U.S. PATENT DOCUMENTS 5,037,280 A * 8/1991 Nishida ..... F01C 17/066 418/55.3
6,027,317 A * 2/2000 Barthod ..... F04C 29/0021 417/410.5
(Continued)

FOREIGN PATENT DOCUMENTS

EP 3480464 A1 5/2020
JP 2006-207406 A 8/2006
(Continued)

OTHER PUBLICATIONS

Office Action issued in Japanese Patent Application No. 2018-044164 dated Jan. 7, 2020 with an English Translation.

*Primary Examiner* — Deming Wan
(74) *Attorney, Agent, or Firm* — Birch, Stewart, Kolasch & Birch, LLP

(57) ABSTRACT

The present invention provides a co-rotating scroll compressor that can inhibit leakage of lubricant supplied to a synchronous drive mechanism. A co-rotating scroll compressor includes a drive-side plate 20 placed between a driving scroll member 70 and a motor 5 at a predetermined distance from the driving scroll member 70 in a direction of a drive-side rotation axis CL1. The drive-side plate 20 includes a shaft portion 20*b* fixed to a driving shaft 6 of the motor 5 and a fixing portion 20*a* fixed to an outer periphery of the driving scroll member 70, and a synchronous drive mechanism made up of a needle bearing 32*a* and a pin 32*b* is placed between the drive-side plate 20 and driving scroll member 70.

9 Claims, 8 Drawing Sheets

(51) Int. Cl.

| | |
|---|---|
| ***F04C 18/02*** | (2006.01) |
| ***F04C 29/00*** | (2006.01) |
| ***F04C 18/00*** | (2006.01) |
| *F01C 21/10* | (2006.01) |

(52) U.S. Cl.
CPC ..... *F04C 29/0071* (2013.01); *F01C 21/10* (2013.01); *F05B 2260/98* (2013.01)

(56) References Cited

U.S. PATENT DOCUMENTS

| | | | | |
|---|---|---|---|---|
| 7,445,437 | B1 * | 11/2008 | Kawazoe | F04C 18/02 418/55.1 |
| 9,869,181 | B2 * | 1/2018 | Fujioka | F01C 1/0238 |
| 10,683,865 | B2 * | 6/2020 | Shaffer | F04C 15/0061 |
| 2013/0315767 | A1 * | 11/2013 | Unami | F01C 21/06 418/55.1 |

FOREIGN PATENT DOCUMENTS

| | | | |
|---|---|---|---|
| JP | 2007-198184 | A | 8/2007 |
| JP | 5443132 | B2 | 3/2014 |
| JP | 2018-21464 | A | 2/2018 |

* cited by examiner

CO-ROTATING SCROLL COMPRESSOR

TECHNICAL FIELD

The present invention relates to a co-rotating scroll compressor.

BACKGROUND ART

Conventionally, a co-rotating scroll compressor is known (see PTL 1). The co-rotating scroll compressor includes a driving scroll and a driven scroll configured to rotate in synchronization with the driving scroll, and rotates a driving shaft configured to rotate the driving scroll and driven shaft configured to support rotation of the driven scroll in a same direction at a same angular velocity by offsetting the driven shaft by a turning radius from the driving shaft.

CITATION LIST

Patent Literature

[PTL 1]
The Publication of Japanese Patent No. 5443132

SUMMARY OF INVENTION

Technical Problem

The co-rotating scroll compressor uses a synchronous drive mechanism configured to transmit a driving force from a driving scroll member to a driven scroll member such that the driving scroll member and driven scroll member performs rotating motion in a same direction at a same angular velocity. As the synchronous drive mechanism, a mechanism using a pin ring, or a crankpin equipped with a rolling bearing is conceivable, but if lubricant supplied to the synchronous drive mechanism leaks out by centrifugal force, the life of the synchronous drive mechanism might be reduced due to lack of lubrication. Also, if the lubricant leaks out, the lubricant might get mixed in a compressed fluid, contaminating the fluid.

The present invention has been made in view of the above circumstances and has an object to provide a co-rotating scroll compressor that can inhibit leakage of lubricant supplied to a synchronous drive mechanism.

Solution to Problem

A co-rotating scroll compressor according to one aspect of the present invention includes: a driving scroll member rotationally driven around a rotation axis by a drive unit and provided with a drive-side wall placed on a drive-side end plate, where the drive-side wall is spiral-shaped; a driven scroll member configured to form a compression space when a driven-side wall corresponding to the drive-side wall is placed on a driven-side end plate and the driven-side wall is meshed with the drive-side wall, where the driven-side wall is spiral-shaped; a synchronous drive mechanism configured to transmit a driving force from a driving shaft to a driven shaft such that the driving scroll member and the driven scroll member performs rotating motion in a same direction at a same angular velocity; a drive-side plate placed between the driving scroll member and the drive unit at a predetermined distance from the driving scroll member in the direction of the rotation axis, wherein the drive-side plate includes a shaft portion connected to the driving shaft and a fixing portion fixed to an outer periphery of the driving scroll member, and the synchronous drive mechanism is placed between the drive-side plate and the driving scroll member.

The drive-side wall placed on the drive-side end plate of the driving scroll member and the driven-side wall of the driven scroll member are meshed with each other, thereby forming the compression space. The driving scroll member is rotationally driven by the drive unit and the driving force is transmitted to the driven scroll member via the synchronous drive mechanism. Consequently, the driven scroll member rotates while performing rotating motion on its axis in the same direction at the same angular velocity as the driving scroll member. In this way, there is provided a scroll compressor of a twin rotary type in which both the driving scroll member and driven scroll member rotate.

As the shaft portion of the drive-side plate is connected to the driving shaft of the drive unit and the fixing portion of the drive-side plate is fixed to the outer periphery of the driving scroll member, the rotational driving force is transmitted to the driving scroll member via the drive-side plate. Since the drive-side plate is placed between the driving scroll member and the drive unit at a predetermined distance from the driving scroll member in the direction of the rotation axis and the rotational driving force is transmitted via the fixing portion fixed to the outer periphery of the driving scroll member, a space can be formed between the driving scroll member and drive-side plate, extending from the fixing portion provided on the outer periphery to an inner peripheral side including the rotation axis. That is, in order to transmit the rotational driving force from the drive unit to the driving scroll member, there is no need to provide a driving shaft connected directly to the driving scroll member by extending on the rotation axis. This makes it possible to provide the synchronous drive mechanism between the driving scroll member and drive-side plate without providing a member with a through-hole or the like formed therein to avoid the driving shaft connected directly to the driving scroll member. This in turn makes it possible to adopt a structure configured to house the synchronous drive mechanism, avoid lack of lubrication by inhibiting leakage of lubricant supplied to the synchronous drive mechanism, and thereby achieve longer life and inhibit contamination of compressed fluid with the lubricant.

Examples of mechanisms available for use as the synchronous drive mechanism include a pin ring mechanism, a crank pin mechanism, an Oldham linkage, and a pin ring mechanism that uses two pins.

Furthermore, the co-rotating scroll compressor according to one aspect of the present invention further includes a driven-side housing section connected to the driven scroll member, placed between the driving scroll member and drive-side plate, and configured to house the synchronous drive mechanism in an internal space.

The driven-side housing section configured to house the synchronous drive mechanism in an internal space is provided by being connected to the driven scroll member and placed between the driving scroll member and drive-side plate. This makes it possible to inhibit leakage of lubricant by housing the synchronous drive mechanism.

Furthermore, in the co-rotating scroll compressor according to one aspect of the present invention, the driven-side housing section includes a first side plate connected to the driven-side end plate, and a second side plate configured to form the internal space in conjunction with the first side plate.

Furthermore, in the co-rotating scroll compressor according to one aspect of the present invention, the driven-side housing section includes the driven-side end plate, and a second side plate configured to form the internal space in conjunction with the driven-side end plate.

Furthermore, in the co-rotating scroll compressor according to one aspect of the present invention, the driven-side housing section includes a plurality of shaft segments divided around a driven-side rotation axis and configured to extend in a direction of the driven-side rotation axis along which the driven scroll member rotates; and a plurality of through-holes corresponding to the shaft segments are formed in the drive-side plate to pass the respective shaft segments therethrough.

The plurality of shaft segments is provided in the driven-side housing section and the through-holes are formed in the drive-side plate to pass the respective shaft segments therethrough. Consequently, the driven scroll member can be rotatably supported by the shaft segments at a position (e.g., a position in a housing) on the drive-unit side with respect to the drive-side plate.

Furthermore, the co-rotating scroll compressor according to one aspect of the present invention further includes an insertion member inserted in a space between circumferentially adjacent ones of the shaft segments.

By inserting the insertion member between circumferentially adjacent ones of the shaft segments, the plurality of shaft segments is integrated. This improves the strength of the shaft segments.

Furthermore, in the co-rotating scroll compressor according to one aspect of the present invention, the driven-side housing section includes a cylindrical shaft portion shaped like a cylinder and configured to extend in a direction of the driven-side rotation axis along which the driven scroll member rotates; and a cylindrical shaft portion fixing portion located on an outer peripheral side of the drive-side plate and configured to connect between the cylindrical shaft portion and the driven-side housing section.

The cylindrical shaft portion is provided in the driven-side housing section and fixed by the cylindrical shaft portion fixing portion located on the outer peripheral side of the drive-side plate. This makes it possible to adopt the cylindrical shaft portion without the need to adopt the shaft segments divided in a circumferential direction and thereby increase the rigidity of the shaft portion.

Advantageous Effects of Invention

By fixing the drive-side plate to the outer periphery of the driving scroll member and placing the synchronous drive mechanism between the driving scroll member and drive-side plate, leakage of the lubricant supplied to the synchronous drive mechanism can be inhibited.

DESCRIPTION OF EMBODIMENTS

Embodiments of the present invention will be described below with reference to the drawings.

First Embodiment

A first embodiment of the present invention will be described below with reference to FIG. 1 and the like.

Figure 1:
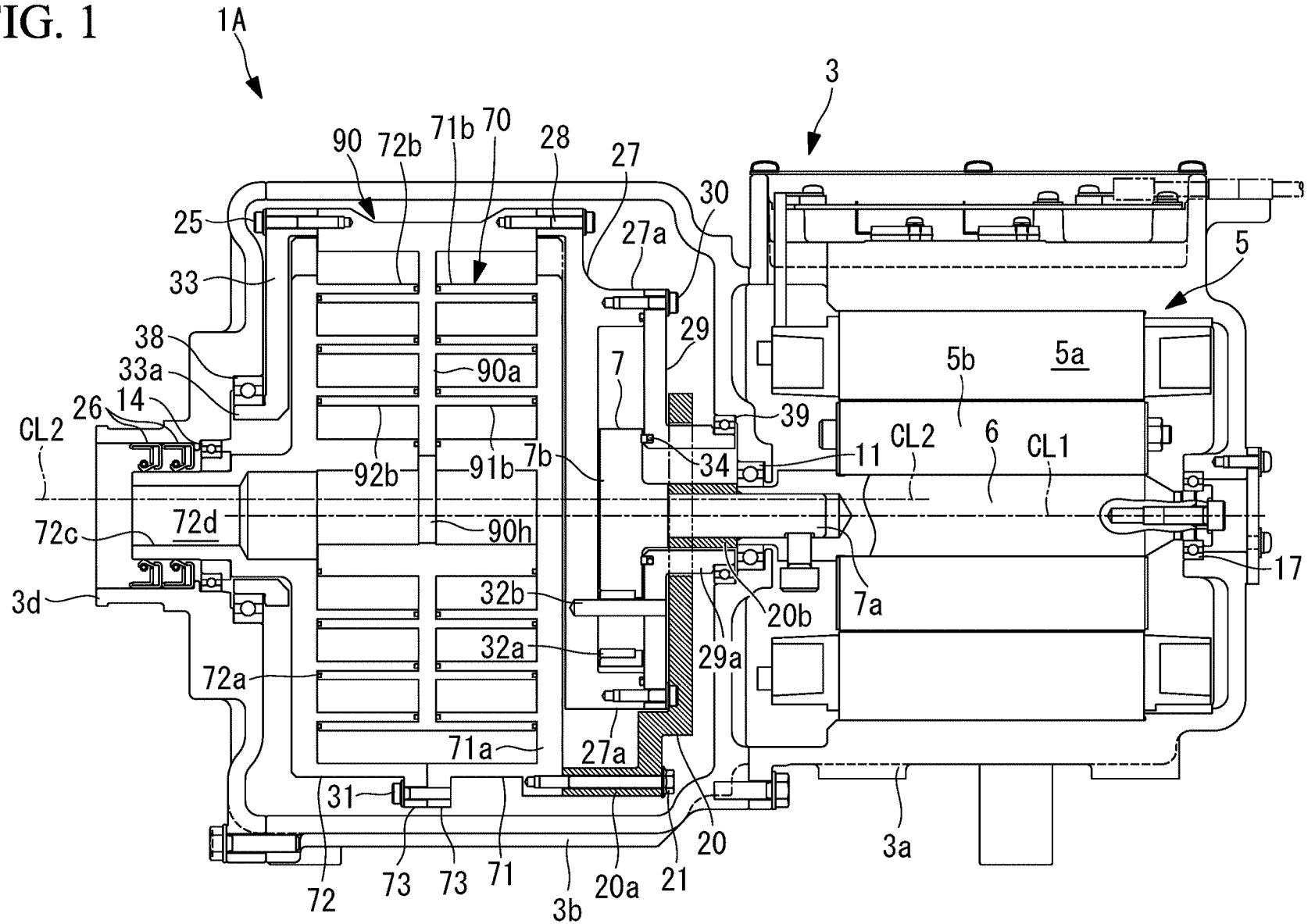
FIG. 1 is a longitudinal sectional view showing a co-rotating scroll compressor according to a first embodiment of the present invention.

A co-rotating scroll compressor 1A is shown in FIG. 1. The co-rotating scroll compressor 1A can be used, for example, as a supercharger configured to compress combustion air (fluid) to be supplied to an internal combustion engine such as a vehicle engine, a compressor used to supply compressed air to electrodes of fuel cells, or a compressor used to supply compressed air used for a braking device of a railroad vehicle or other kinds of vehicles.

The co-rotating scroll compressor 1A includes a housing 3, a motor (drive unit) 5 housed on one end side of the housing 3, and a driving scroll member 70 and driven scroll member 90 housed on another end side of the housing 3.

The housing 3 has a substantially cylindrical shape and includes a motor housing section 3*a* configured to house the motor 5 and a scroll housing section 3*b* configured to house the scroll members 70 and 90.

A discharge orifice 3*d* used to discharge air after compression is formed in an end portion of the scroll housing section 3*b*. Note that although not illustrated in FIG. 1, the housing 3 is provided with an air inlet port used to suck air.

The motor 5 is driven by being supplied with electric power from a non-illustrated power supply source. Rotation control of the motor 5 is performed on instructions from a non-illustrated control unit.

A stator 5*a* of the motor 5 is fixed to an inner peripheral side of the housing 3. A rotor 5*b* of the motor 5 rotates around a drive-side rotation axis CL1.

The rotor 5*b* is connected with a driving shaft 6 extending on the drive-side rotation axis CL1. A front end (left end in FIG. 1) of the driving shaft 6 is connected with a connecting shaft portion 7*a* provided on a center plate 7. The central axis of the connecting shaft portion 7*a* coincides with the drive-side rotation axis CL1 as with the driving shaft 6. Consequently, the driving shaft 6 is extended by the connecting shaft portion 7*a*.

A drive-side bearing 11 configured to rotatably support the driving shaft 6 is provided on the front end of the driving shaft 6. A rear-end bearing 17 configured to rotatably support the driving shaft 6 in conjunction with the housing 3 is provided on a rear end (right end in FIG. 1) of the driving shaft 6, i.e., on that end portion of the driving shaft 6 which is opposite the driving scroll member 70.

The driving scroll member 70 includes a first driving scroll unit 71 on the side of the motor 5 and a second driving scroll unit 72 on the side of the discharge orifice 3*d*.

The first driving scroll unit 71 includes a first drive-side end plate and a first drive-side wall 71*b*.

The first drive-side end plate 71*a* extends in a direction orthogonal to the drive-side rotation axis CL1. The first drive-side end plate 71*a* does not include a driving shaft portion that extends on the drive-side rotation axis CL1. That is, a surface of the first drive-side end plate 71*a* on the side of the motor 5 is a flat surface.

The first drive-side end plate 71*a* is connected with the drive-side plate 20. The drive-side plate 20 extends in parallel to the first drive-side end plate 71*a*. The drive-side plate 20 is connected to an outer periphery of the first drive-side end plate 71*a* via a fixing portion 20*a* provided on an outer peripheral edge.

The fixing portion 20*a* has a tubular shape and extends in parallel to the drive-side rotation axis CL1. A through-hole is formed in the fixing portion 20*a*, and a bolt 21 is inserted into the through-hole to fix the fixing portion 20*a* to the first drive-side end plate 71*a*.

A shaft portion 20*b* is provided in a center of the drive-side plate 20. The shaft portion 20*b* is cylindrical in shape and is fixed, on an inner peripheral side, to an outer peripheral side of the connecting shaft portion 7*a* of the center plate 7. The central axis of the shaft portion 20*b* coincides with the drive-side rotation axis CL1. Consequently, the shaft portion 20*b* of the drive-side plate 20 is fixed to the driving shaft 6. The shaft portion 20*b* and connecting shaft portion 7*a* are connected with each other by means of serrations, shrinkage fit, a bolt, a key, or the like.

Figure 2:
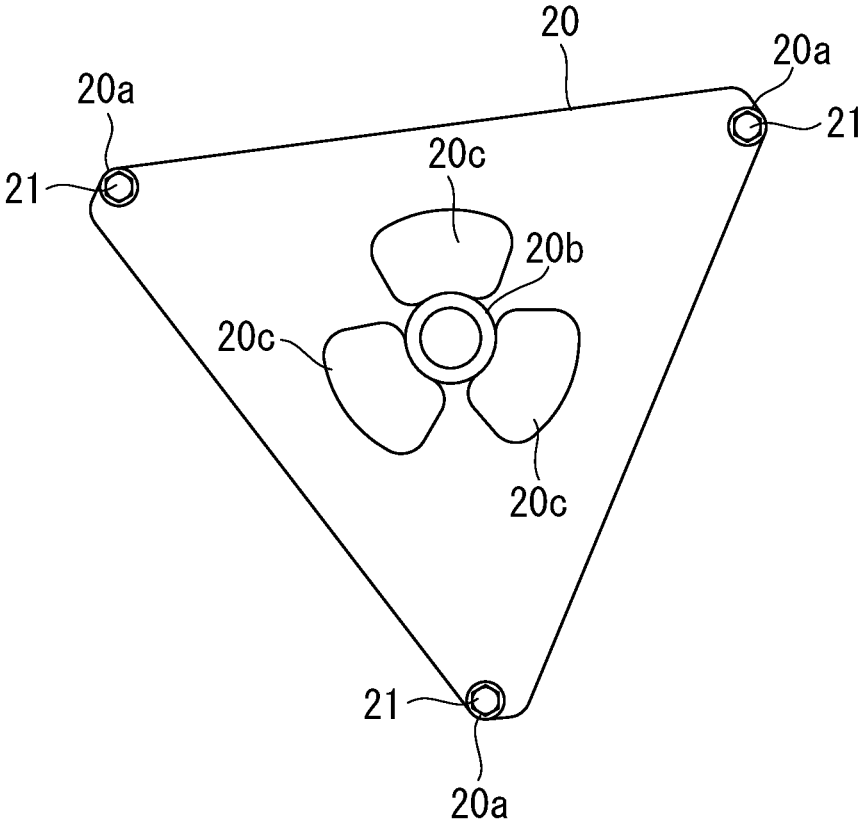
FIG. 2 is a plan view showing a drive-side plate.

A plan view of the drive-side plate 20 is shown in FIG. 2. The drive-side plate 20 has an outside shape that is substantially triangular in plan view. The fixing portion 20*a* is provided at each vertex of the triangle and the shaft portion 20*b* is provided in a central part. Three through-holes 20*c* are formed on an outer peripheral side of the shaft portion 20*b* by being spaced away at equal intervals in a circumferential direction. Respective shaft segments 29*a* (see, for example, FIG. 5) described later is passed through the through-holes 20*c*. The number of through-holes 20*c* corresponds to the number of shaft segments 29*a*.

Figure 3:
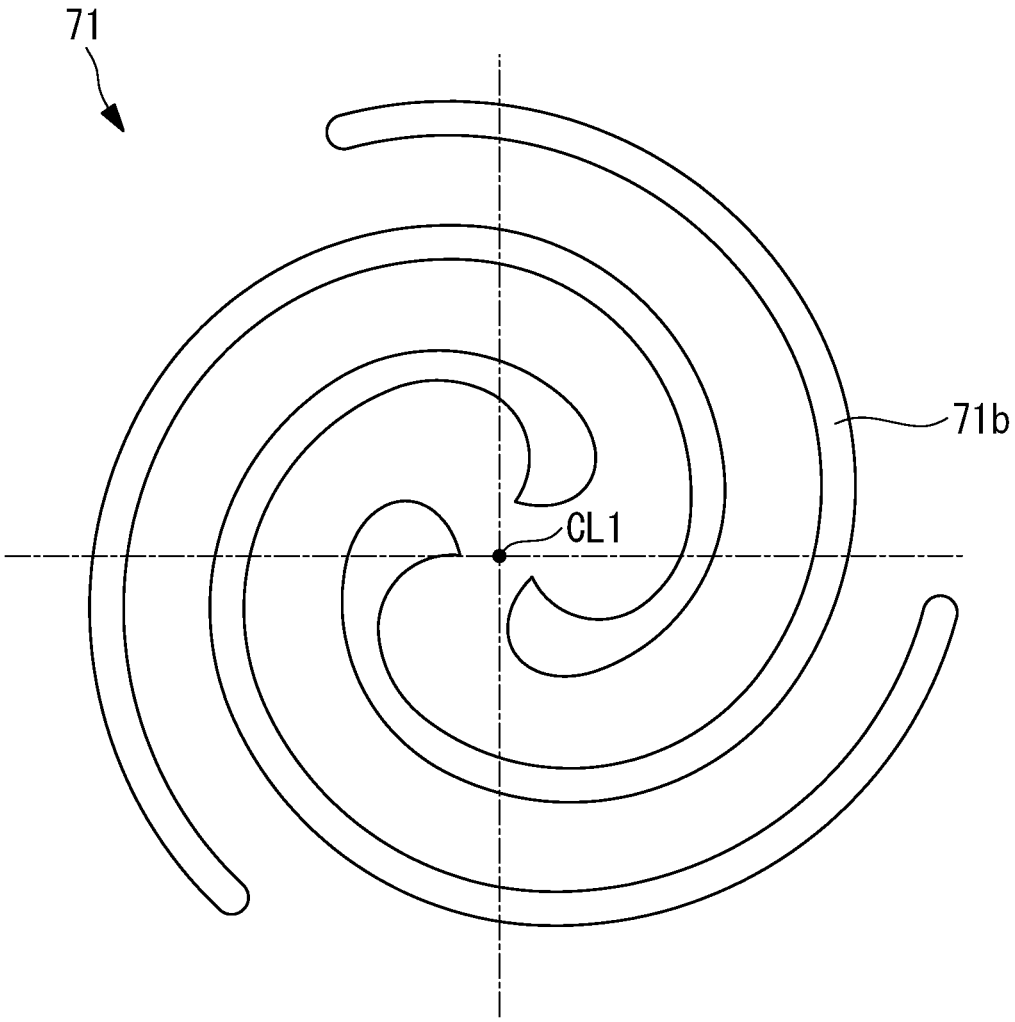
FIG. 3 is a plan view showing a first drive-side wall of FIG. 1.
Figure 4:
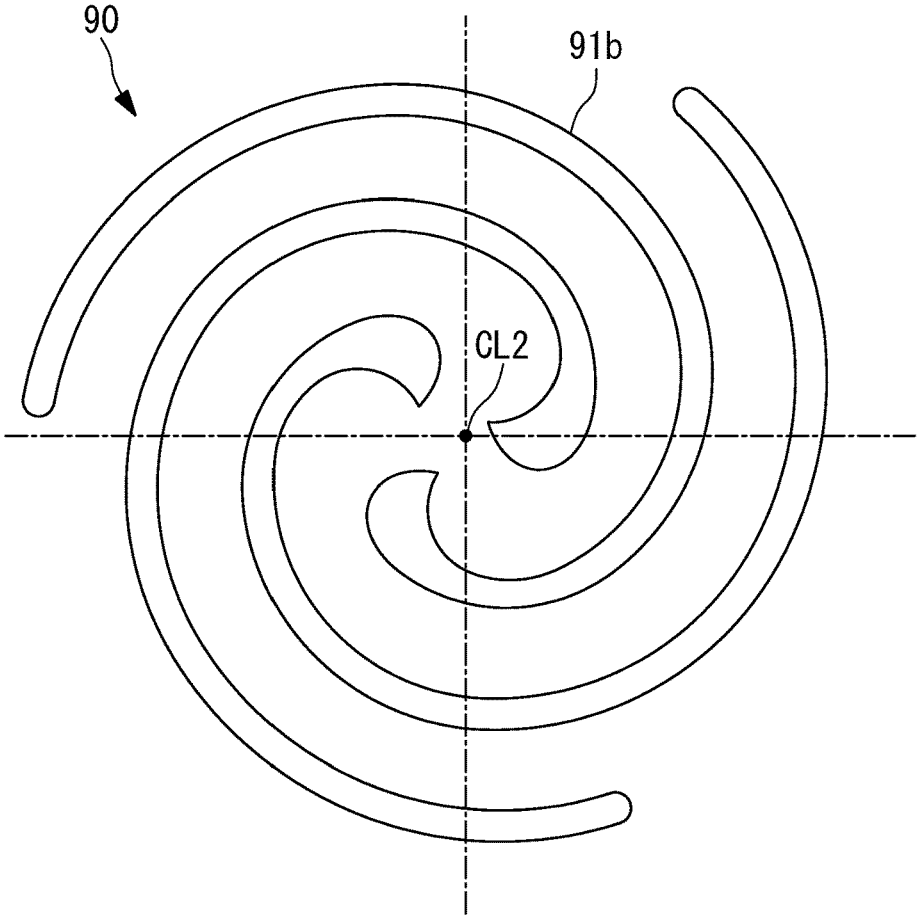
FIG. 4 is a plan view showing a first driven-side wall of FIG. 1.

The first drive-side end plate 71*a* is substantially disk-shaped in plan view. As shown in FIG. 3, three first drive-side walls 71*b*, spiral in shape, are provided on the first drive-side end plate 71*a*. The three first drive-side walls 71*b* are arranged at equal intervals around the drive-side rotation axis CL1. Note that the number of first drive-side walls 71*b* may be less than or more than three.

As shown in FIG. 1, the second driving scroll unit 72 includes a second drive-side end plate 72*a* and second drive-side walls 72*b*. As with the first drive-side wall 71*b* (see FIG. 3), three second drive-side walls 72*b* are provided. Note that the number of second drive-side walls 72*b* may be less than or more than three.

The second drive-side end plate 72*a* is connected with a second drive-side shaft portion 72*c* extending in a direction of the drive-side rotation axis CL1. The second drive-side shaft portion 72*c* is provided rotatably with respect to the housing 3 via a second drive-side bearing 14. A discharge port 72*d* is formed in the second drive-side end plate 72*a* along the drive-side rotation axis CL1.

Between the second drive-side shaft portion 72*c* and housing 3, two sealing members 26 are provided on a front end side (left end in FIG. 1) of the second drive-side shaft portion 72*c* than is the second drive-side bearing 14. The two sealing members 26 are placed at a predetermined distance from the second drive-side bearing 14 in the direction of the drive-side rotation axis CL1. Note that the number of sealing members 26 may be one.

The first driving scroll unit 71 and second driving scroll unit 72 are fixed with front ends (free ends) of respective walls 71*b* and 72*b* facing each other. The first driving scroll unit 71 and second driving scroll unit 72 are fixed to each other using bolts 31 fastened to flanges 73 provided at plural locations in a circumferential direction, protruding radially outward.

A driven-side end plate 90*a* of the driven scroll member 90 is located substantially at a center in an axial direction (horizontal direction in FIG. 1). A through-hole 90*h* is formed in the center of the driven-side end plate 90*a* such that air after compression will flow to the discharge port 72*d*.

Driven-side walls 91*b* and 92*b* are provided on opposite sides of the driven-side end plate 90*a*. A first driven-side wall 91*b* installed extending from the driven-side end plate 90*a* toward the motor 5 is meshed with the first drive-side wall 71*b* of the first driving scroll unit 71, and a second driven-side wall 92*b* installed extending from the driven-side end plate 90*a* toward the discharge orifice 3*d* is meshed with the second drive-side wall 72*b* of the second driving scroll unit 72.

As shown in FIG. 3, three first driven-side walls 91*b* are provided. The three first driven-side walls 91*b* are arranged at equal intervals around a driven-side rotation axis CL2. The second driven-side walls 92*b* have a similar configuration. Note that the number of first driven-side walls may be less than or more than three, and so may the number of second driven-side walls 92*b*.

A support member 33 is provided on that side (left side in FIG. 1) of the driven scroll member 90 which is closer to the discharge orifice 3*d*. The support member 33 is fixed to front ends (free ends) of the second driven-side walls 92*b* with bolts 25.

A support member shaft portion 33*a* is provided around a central axis of the support member 33 and fixed to the housing 3 via a second support member bearing 38. Consequently, the driven scroll member 90 rotates around the driven-side rotation axis CL2 via the support member 33.

A first side plate 27 is provided on that side (right side in FIG. 1) of the first drive-side end plate 71*a* which is closer to the motor 5. The first side plate 27 is fixed to front ends (free ends) of the first driven-side walls 91*b* with bolts 28. The first side plate 27 is provided in parallel to the first drive-side end plate 71*a*. An endless peripheral wall 27*a* is erected on the first side plate 27, facing toward the motor 5. Consequently, a recess is formed in the first side plate 27, opening toward the motor 5.

A second side plate 29 is provided on a front end side (right side in FIG. 1) of the peripheral wall 27*a*. The second side plate 29 is fixed to the peripheral wall 27*a* with bolts. A through-hole is formed in a center of the second side plate 29 to pass the connecting shaft portion 7*a* of the center plate 7 therethrough.

A plate portion 7*b* of the center plate 7 is contained in a space surrounded by the first side plate 27 and second side plate 29. A needle bearing 32*a* having plural needles is provided in the plate portion 7*b*. A pin 32*b* coming into rolling contact with the needle bearing 32*a* is provided. End portions of the pin 32*b* are fixed to the first side plate 27 and second side plate 29, respectively. A pin ring mechanism made up of the needle bearing 32*a* and pin 32*b* make up a synchronous drive mechanism.

In this way, the first side plate 27 and second side plate 29 make up a driven-side housing section configured to house the synchronous drive mechanism in internal space. The synchronous drive mechanism transmits a driving force between the driving scroll member 70 and driven scroll member 90 such that the driving scroll member 70 and driven scroll member 90 will perform rotating motion in a same direction at a same angular velocity. Lubricant is supplied to the synchronous drive mechanism for wear reduction and other purposes. Note that a crankpin mechanism or a double-pin ring mechanism that uses two pins may be used instead of the pin ring mechanism. Also, by omitting the needle bearing 32*a* used in the pin ring mechanism, the mechanism may be configured to transmit power by sliding friction between the pin 32*b* and a round hole.

An O-ring 34 is provided as a sealing member on a center side of the second side plate 29. The O-ring 34 is provided, forming a seal with an end face of the plate portion 7*b* of the center plate 7. Lubricant for the pin ring mechanism is enclosed by the O-ring 34 in a housing space formed between the first side plate 27 and second side plate 29. In this way, the O-ring 34 installed at a single location is sufficient as a sealing member configured to seal the housing space for use to enclose the lubricant.

Figure 5:
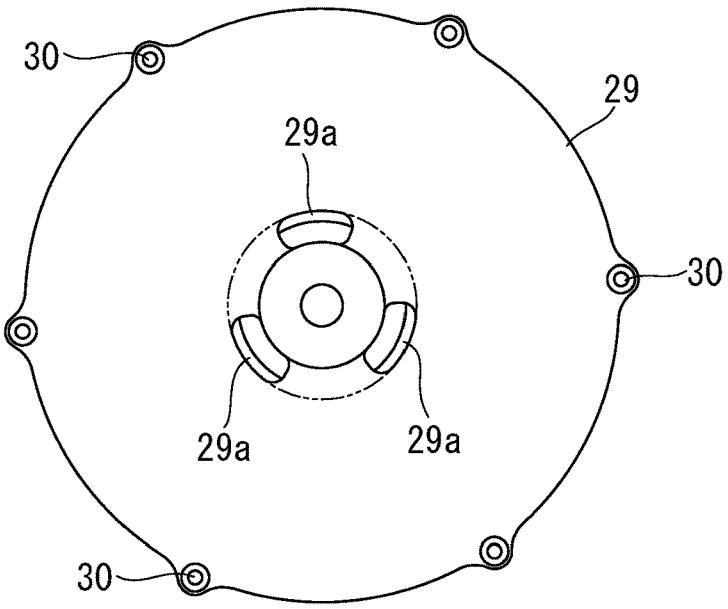
FIG. 5 is a plan view showing a second side plate.

The shaft segments 29*a* are provided in a center of the second side plate 29, protruding toward the motor 5 in parallel to the driven-side rotation axis CL2. Front ends of the shaft segments 29*a* are axially supported by a side plate bearing 39 provided in the housing 3. Consequently, the driven scroll member 90 rotates around the driven-side rotation axis CL2 via the second side plate 29 and first side plate 27. As shown in FIG. 5, the shaft segments 29*a* are divided in a circumferential direction and three shaft segments 29*a* are provided, being spaced away from one another in a circumferential direction. Note that regarding the number of shaft segments 29*a*, it is sufficient if two or more shaft segments 29*a* are provided. As shown in FIG. 5, the second side plate 29 has a substantially circular outside shape in plan view.

Figure 6:
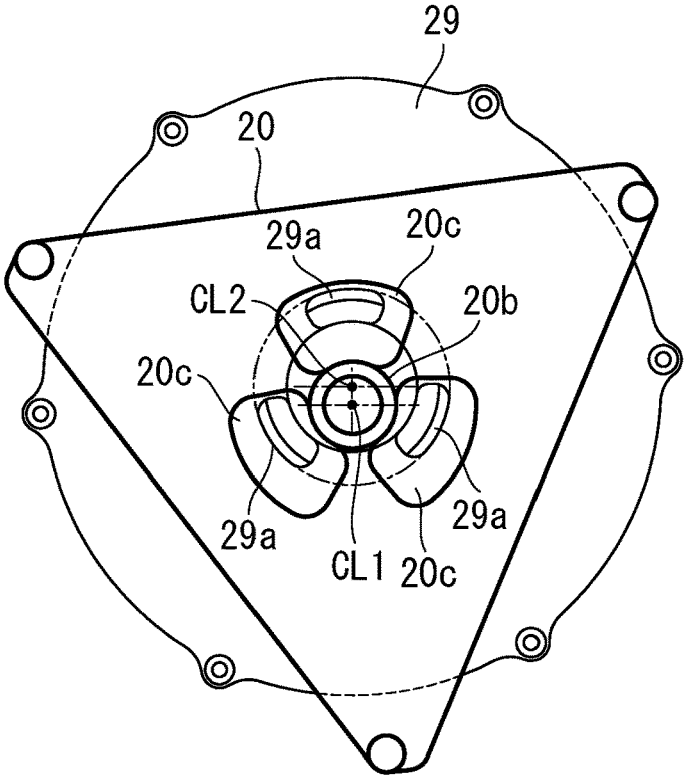
FIG. 6 is a plan view showing the drive-side plate and second side plate.

The drive-side plate 20 shown in FIG. 2 and the second side plate 29 shown in FIG. 5 are combined together and shown in FIG. 6. As shown in FIG. 6, the shaft segments 29*a* are passed, respectively, through the plural through-holes 20*c* formed in the drive-side plate 20.

Figure 7:
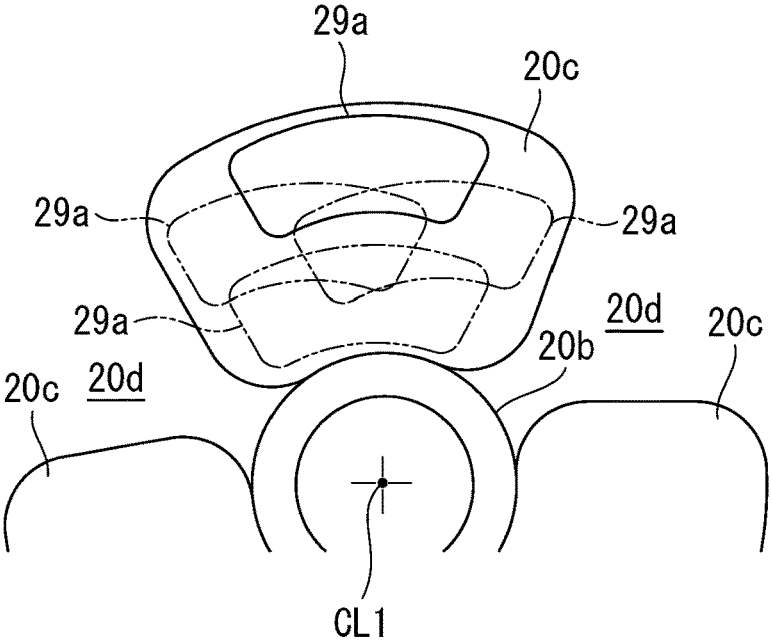
FIG. 7 is a partially enlarged plan view showing a shaft segment configured to perform a relative movement in a through-hole formed in the drive-side plate.

As shown in FIG. 7, the shape of each through-hole 20*c* is determined based on a trajectory of the shaft segment 29*a* such that the shaft segment 29*a* will not interfere with an edge of the through-hole 20*c* when the driving scroll member 70 and driven scroll member 90 perform turning motion relative to each other. FIG. 7 shows positions of the shaft segment 29*a* at different turning angles. The shape of each through-hole 20*c* is a substantially rectangular shape whose sides on the inner periphery and outer periphery are arcs of circles centered at the drive-side rotation axis CL1. The driving force is transmitted from the shaft portion 20*b* by a connection region 20*d* remaining between adjacent through-holes 20*c*.

The co-rotating scroll compressor 1A with the above configuration operates as follows.

When the driving shaft 6 is rotated around the drive-side rotation axis CL1 by the motor 5, the center plate 7 also rotates around the drive-side rotation axis CL1 together with the driving scroll member 70 via the drive-side plate 20 fixed to the connecting shaft portion 7*a* of the center plate 7 connected to the driving shaft 6. The driving force transmitted to the center plate 7 along with rotation of the center plate 7 is transmitted from the first side plate 27 and second side plate 29 to the driven scroll member 90 via the needle bearing 32*a* and pin 32*b* serving together as the synchronous drive mechanism, and thereby causes the driven scroll member 90 to rotate around the driven-side rotation axis CL2. Consequently, the two scroll members 70 and 90 perform revolving motion relative to each other.

When the two scroll members 70 and 90 perform revolving motion, the air sucked through an inlet port in the housing 3 is sucked from outer peripheral sides of the two scroll members 70 and 90 and taken into a compression chamber formed by the two scroll members 70 and 90. Then, a compression chamber formed by the first drive-side walls 71*b* and first driven-side walls 91*b* and a compression chamber formed by the second drive-side walls 72*b* and second driven-side walls 92*b* are compressed separately. Each of the compression chambers is reduced in volume toward the center, and air is compressed accordingly. The air compressed by the first drive-side walls 71*b* and first driven-side walls 91*b* passes through the through-hole 90*h* formed in the driven-side end plate 90*a* and joins the air compressed by the second drive-side walls 72*b* and second driven-side walls 92*b*. The gas resulting from the joining passes through the discharge port 72*d* and is discharged outside the housing 3 through the discharge orifice 3*d*.

The present embodiment achieves the following operations and effects.

Since the shaft portion 20*b* of the drive-side plate 20 is fixed to the driving shaft 6 of the motor 5 via the connecting shaft portion 7*a* and the fixing portion 20*a* of the drive-side plate 20 is fixed to the outer periphery of the driving scroll member 70, the rotational driving force of the motor 5 is transmitted to the driving scroll member 70 via the drive-side plate 20. Since the drive-side plate 20 is placed between the driving scroll member 70 and the motor 5 at a predetermined distance from the driving scroll member 70 in the direction of the drive-side rotation axis CL1 and the rotational driving force is transmitted via the fixing portion 20*a* fixed to the outer periphery of the driving scroll member 70, a space can be formed between the driving scroll member 70 and drive-side plate 20, extending from the fixing portion 20*a* provided on the outer periphery to the inner peripheral side including the drive-side rotation axis CL1. That is, in order to transmit the rotational driving force from the motor 5 to the driving scroll member 70, there is no need to provide a driving shaft connected directly to the first drive-side end plate 71*a* of the driving scroll member 70 by extending on the drive-side rotation axis CL1. This makes it possible to provide the synchronous drive mechanism (needle bearing 32*a* and pin 32*b*) between the driving scroll member 70 and drive-side plate 20 without forming a through-hole in the first side plate 27 to pass a driving shaft connected directly to the first drive-side end plate 71*a* therethrough. This in turn makes it possible to adopt a structure configured to house the synchronous drive mechanism, avoid lack of lubrication by inhibiting leakage of lubricant supplied to the synchronous drive mechanism, and thereby achieve longer life and inhibit contamination of compressed fluid with the lubricant.

The first side plate 27 fixed to the driven scroll member 90 and the second side plate 29 configured to form a housing space in conjunction with the first side plate 27 are provided making up a driven-side housing section configured to house the synchronous drive mechanism. This makes it possible to inhibit leakage of lubricant by housing the synchronous drive mechanism.

The plural shaft segments 29*a* are provided in the second side plate 29 and the through-holes 20*c* are formed in the drive-side plate 20 to pass the respective shaft segments 29*a* therethrough. Consequently, the driven scroll member 90 can be rotatably and axially supported by the shaft segments 29*a* at a position in the housing 3 on the motor 5 side with respect to the drive-side plate 20.

[Modification]

Figure 8:
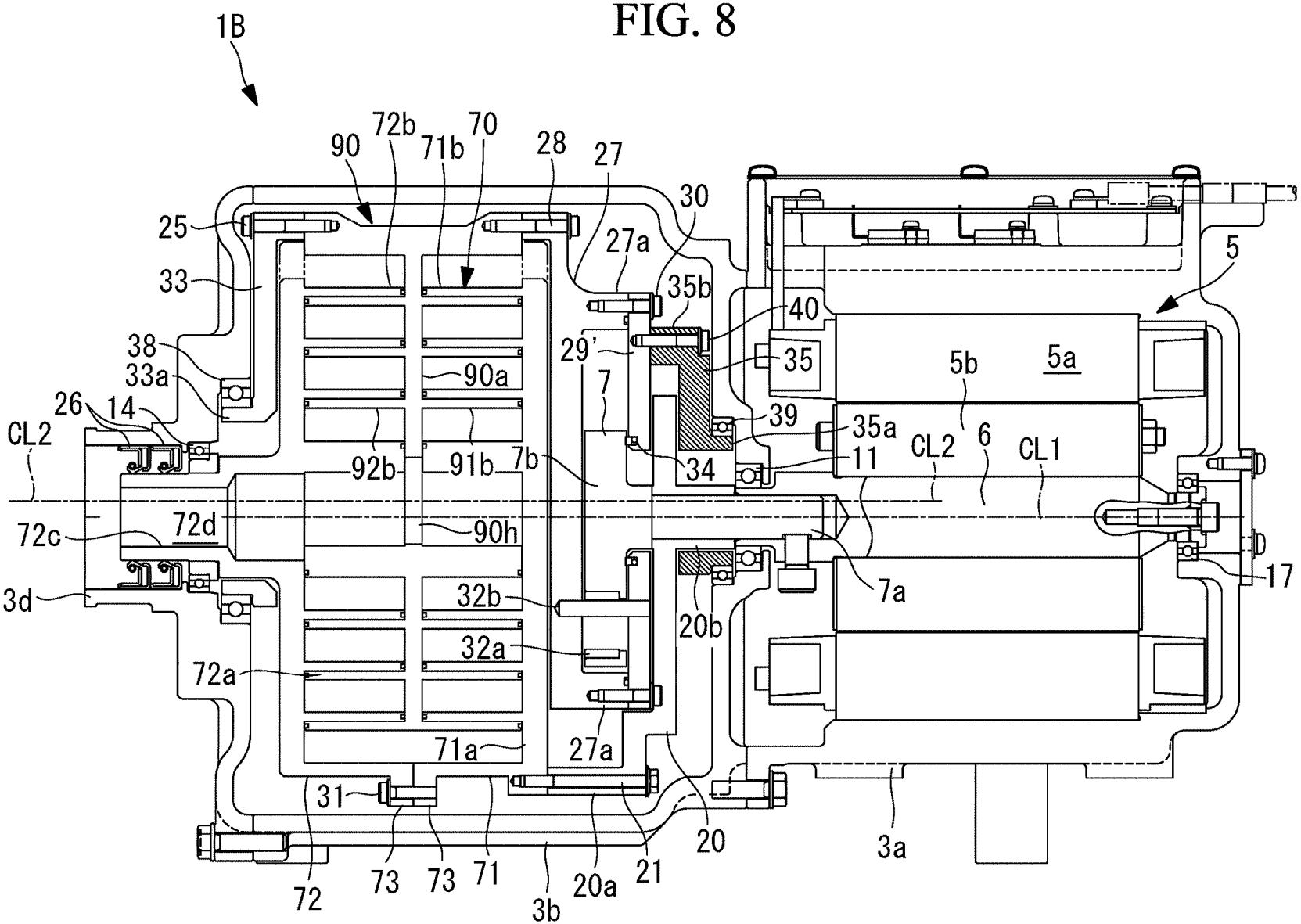
FIG. 8 is a longitudinal sectional view showing a co-rotating scroll compressor according to a modification.

Note that the co-rotating scroll compressor 1A shown in FIG. 1 can be modified as shown in FIG. 8. A co-rotating scroll compressor 1B according to the present modification does not include the shaft segments 29*a* of the co-rotating scroll compressor 1A shown in FIG. 1 (see FIG. 5).

As shown in FIG. 8, a third side plate 35 is fixed to that side of the second side plate' 29 which is closer to the motor 5. A fixing portion (cylindrical shaft portion fixing portion) 35*b* is provided in an end portion of the third side plate 35, extending in parallel to the driven-side rotation axis CL2 on an outer peripheral side of the drive-side plate 20. Using a bolt 40 passed through a through-hole formed in the fixing portion 35*b*, the third side plate 35 is fixed to an outer periphery of the second side plate 29'. A cylindrical shaft portion 35*a*, cylindrical in shape, is provided on a center side of the third side plate 35. The cylindrical shaft portion 35*a* is axially supported by a side plate bearing 39 provided in the housing 3.

Since the third side plate 35 is fixed to the second side plate' 29 using a region on the outer peripheral side of the drive-side plate 20, the present modification allows the cylindrical shaft portion 35*a* to be adopted without the need to adopt the shaft segments shown in FIG. 5 and thereby allows the rigidity of the shaft portion to be increased.

Second Embodiment

Next, a second embodiment of the present invention will be described with reference to FIG. 9. The present embodiment has a structure resulting from omitting the first side plate 27 of the co-rotating scroll compressor 1A according to the first embodiment shown in FIG. 1. Also, in a co-rotating scroll compressor 1C according to the present embodiment, the driving scroll member 70 and driven scroll member 90 of the co-rotating scroll compressor 1A shown in FIG. 1 are exchanged with each other to use the driving scroll member 70 as a driven scroll member, and the driven scroll member 90 as a driving scroll member. Therefore, in the following description, the driven scroll member of the co-rotating scroll compressor 1C according to the present embodiment corresponding to the driving scroll member 70 of the co-rotating scroll compressor 1A shown in FIG. 1 will be denoted by putting an apostrophe (') after the reference sign of the corresponding component and the driving scroll member of the co-rotating scroll compressor 1C according to the present embodiment corresponding to the driven scroll member 90 of the co-rotating scroll compressor 1A shown in FIG. 1 will be denoted by putting an apostrophe (') after the reference sign of the corresponding component. Also, the same components as those in the first embodiment are denoted by the same reference numerals as the corresponding components of the first embodiment, and description thereof will be omitted.

Figure 9:
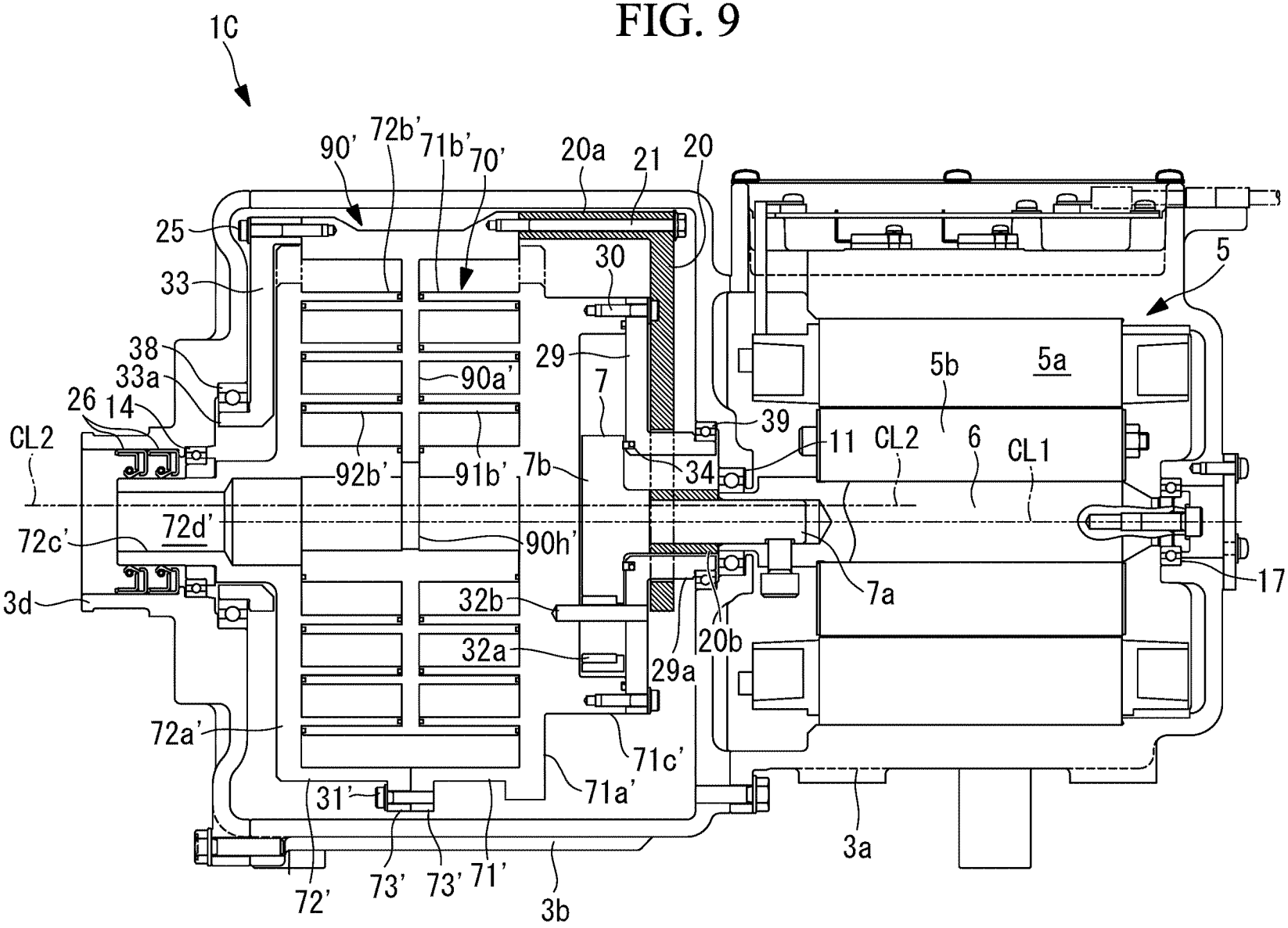
FIG. 9 is a longitudinal sectional view showing a co-rotating scroll compressor according to a second embodiment of the present invention.

As shown in FIG. 9, around a first driven-side end plate 71*a*' of a driven scroll member 70', an endless peripheral wall 71*c*' is erected on the side of the motor 5. The second side plate 29 is fixed to the peripheral wall 71*c*' with bolts 30. The shaft segments 29*a* are provided on the center side of the second side plate 29, extending in the direction of the drive-side rotation axis CL1. The shaft segments 29*a* are axially supported by the side plate bearing 39.

The drive-side plate 20 is fixed to a driving scroll member 90' with the bolt 21. Consequently, the rotational driving force of the motor 5 is transmitted from the driving shaft 6 to the drive-side plate 20 via the connecting shaft portion 7*a* of the center plate 7, thereby rotationally driving the driving scroll member 90'.

In this way, the present embodiment achieves operations and effects similar to those of the first embodiment, allows the first side plate 27 of the co-rotating scroll compressor 1A shown in FIG. 1 to be omitted, and enables cost reductions. Also, since the first side plate 27 is omitted, members that determine phases of the driving scroll member and driven scroll member are reduced, making phase matching easier. This reduces leakage of compressed fluid, resulting in improved efficiency.

Figure 10A:
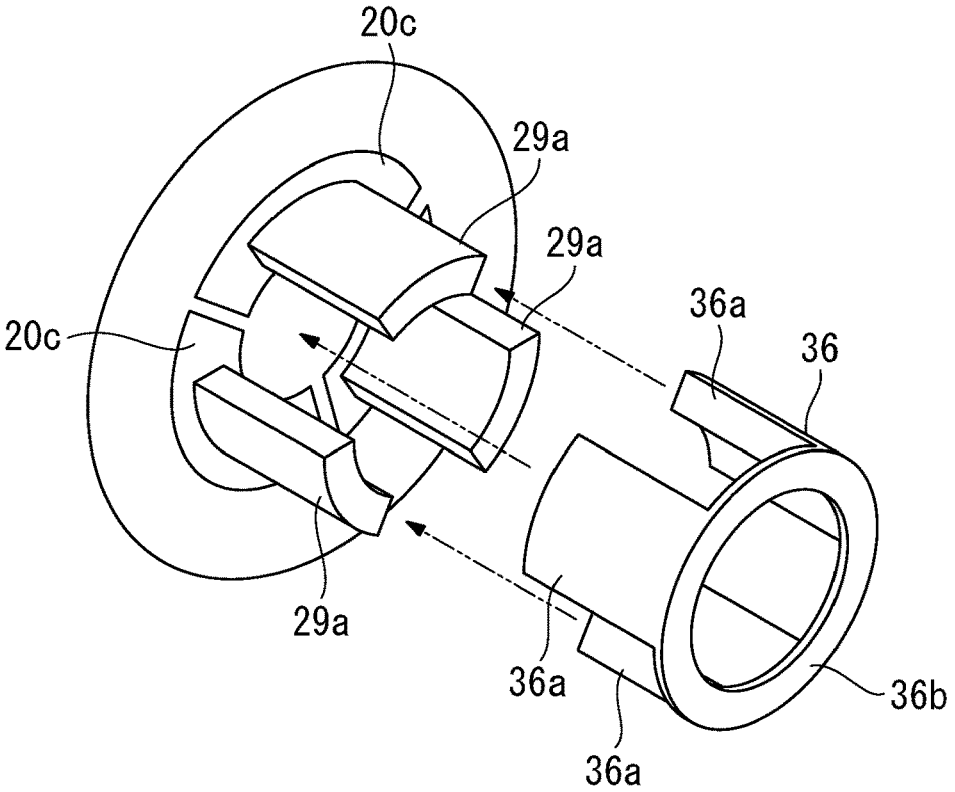
FIG. 10A is a perspective view showing shaft segments and an insertion member.
Figure 10B:
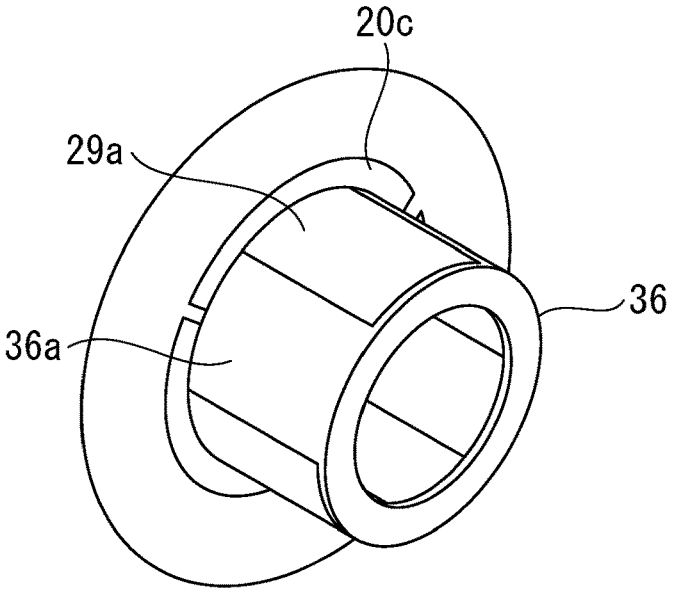
FIG. 10B is a perspective view showing how the insertion member is fitted in the shaft segments.

Note that as shown in FIGS. 10A and 10B, an insertion member 36 may be inserted into spaces formed between pairs of circumferentially adjacent shaft segments 29*a* according to the first embodiment or second embodiment. The insertion member 36 includes insertion portions 36*a* corresponding to the spaces formed between the pairs of circumferentially adjacent shaft segments 29*a* and an annular portion 36*b* integrating the insertion portions 36*a* on a front end side. A cylindrical shaft portion is formed by fitting the insertion member 36 over the shaft segments 29*a* and thereby integrating the insertion member 36 and shaft segments 29*a*. This improves the strength of the shaft segments.

REFERENCE SIGNS LIST

1A, 1B, 1C Co-rotating scroll compressor
3 Housing
3*a* Motor housing section
3*b* Scroll housing section
3*d* Discharge orifice
5 Motor (drive unit)
5*a* Stator
5*b* Rotor
6 Driving shaft
7 Center plate
7*a* Connecting shaft portion
7*b* Plate portion
11 Drive-side bearing
14 Second drive-side bearing
17 Rear-end bearing
20 Drive-side plate
20*a* Fixing portion
20*b* Shaft portion
20*c* Through-hole
20*d* Connection region
21 Bolt
25 Bolt
26 Sealing member
27 First side plate
27*a* Peripheral wall
28 Bolt
29, 29' Second side plate
29*a* Shaft segment
30 Bolt
31 Bolt
32*a* Needle bearing
32*b* Pin
34 O-ring
35 Third side plate
35*a* Cylindrical shaft portion
35*b* Fixing portion (cylindrical shaft portion fixing portion)
36 Insertion member
36*a* Insertion portion
36*b* Annular portion
39 Side plate bearing

40 Bolt
70 Driving scroll member
71 First driving scroll unit
71*a* First driven-side end plate
71*b* First drive-side wall
72 Second driving scroll unit
72*a* Second drive-side end plate
72*b* Second drive-side wall
72*c* Second drive-side shaft portion
72*d* Discharge port
90 Driven scroll member
90*a* Driven-side end plate
90*h* Through-hole
91*b* First driven-side wall
92*b* Second driven-side wall
70' Driven scroll member
71' First driven-side scroll unit
71*a'* First driven-side end plate 71*a'*
71*b'* First driven-side wall
71*c'* Peripheral wall
72' Second driven-side scroll unit
72*a'* Second drive-side end plate
72*b'* Second driven-side wall
72*c'* Second driven-side shaft portion
72*d'* Discharge port
90' Driving scroll member
90*a'* Drive-side end plate
90*h'* Through-hole
91*b'* First drive-side wall
92*b'* Second drive-side wall
CL1 Drive-side rotation axis
CL2 Driven-side rotation axis

The invention claimed is:

1. A co-rotating scroll compressor comprising:

a driving scroll member rotationally driven around a rotation axis by a drive unit and provided with a drive-side wall placed on a drive-side end plate, where the drive-side wall is spiral-shaped;

a driven scroll member configured to form a compression space when a driven-side wall corresponding to the drive-side wall is placed on a driven-side end plate and the driven-side wall is meshed with the drive-side wall, where the driven-side wall is spiral-shaped;

a synchronous drive mechanism, including a ring and a pin that engages the ring, configured to transmit a driving force from a driving shaft to a driven shaft such that the driving scroll member and the driven scroll member perform rotating motion in a same direction at a same angular velocity;

a drive-side plate placed between the driving scroll member and the drive unit at a predetermined distance from the driving scroll member in a direction of the rotation axis, wherein the drive-side plate includes a shaft portion connected to the driving shaft and a fixing portion fixed to an outer periphery of the driving scroll member, and the synchronous drive mechanism is placed between the drive-side plate and the driving scroll member.

2. The co-rotating scroll compressor according to claim 1, further comprising:

a driven-side housing section connected to the driven scroll member, placed between the driving scroll member and the drive-side plate, and configured to house the synchronous drive mechanism in an internal space.

3. The co-rotating scroll compressor according to claim 2, wherein the driven-side housing section includes a first side plate connected to the driven-side end plate, and a second side plate configured to form the internal space in conjunction with the first side plate.

4. The co-rotating scroll compressor according to claim 3, wherein:

the driven-side housing section includes a plurality of shaft segments divided around a driven-side rotation axis and configured to extend in a direction of the driven-side rotation axis along which the driven scroll member rotates; and a plurality of through-holes corresponding to the plurality of shaft segments are formed in the drive-side plate to pass the respective shaft segments therethrough.

5. The co-rotating scroll compressor according to claim 2, wherein the driven-side housing section includes the driven-side end plate, and a second side plate configured to form the internal space in conjunction with the driven-side end plate.

6. The co-rotating scroll compressor according to claim 5, wherein:

the driven-side housing section includes a plurality of shaft segments divided around a driven-side rotation axis and configured to extend in a direction of the driven-side rotation axis along which the driven scroll member rotates; and a plurality of through-holes corresponding to the shaft segments are formed in the drive-side plate to pass the respective shaft segments therethrough.

7. The co-rotating scroll compressor according to claim 2, wherein:

the driven-side housing section includes a plurality of shaft segments divided around a driven-side rotation axis and configured to extend in a direction of the driven-side rotation axis along which the driven scroll member rotates; and a plurality of through-holes corresponding to the plurality of shaft segments are formed in the drive-side plate to pass the respective shaft segments therethrough.

8. The co-rotating scroll compressor according to claim 4, further comprising:

an insertion member inserted in a space between circumferentially adjacent ones of the plurality of shaft segments.

9. The co-rotating scroll compressor according to claim 2, wherein:

the driven-side housing section includes a cylindrical shaft portion shaped like a cylinder and configured to extend in a direction of a driven-side rotation axis along which the driven scroll member rotates; and a cylindrical shaft portion fixing portion located on an outer peripheral side of the drive-side plate and configured to connect between the cylindrical shaft portion and the driven-side housing section.

* * * * *